US008206238B2

(12) United States Patent
Kaneko et al.

(10) Patent No.: US 8,206,238 B2
(45) Date of Patent: Jun. 26, 2012

(54) SHAFT FOR GOLF CLUB

(75) Inventors: Takashi Kaneko, Toyohashi (JP); Kouji Shiga, Toyohashi (JP); Tetsuya Atsumi, Toyohashi (JP); Tsutomu Ibuki, Toyohashi (JP)

(73) Assignee: MRC Composite Products Co., Ltd., Toyohashi-shi (JP)

( * ) Notice: Subject to any disclaimer, the term of this patent is extended or adjusted under 35 U.S.C. 154(b) by 257 days.

(21) Appl. No.: 12/677,003

(22) PCT Filed: Sep. 10, 2008

(86) PCT No.: PCT/JP2008/066299

§ 371 (c)(1),
(2), (4) Date: Mar. 8, 2010

(87) PCT Pub. No.: WO2009/034986

PCT Pub. Date: Mar. 19, 2009

(65) Prior Publication Data

US 2010/0323810 A1 Dec. 23, 2010

(30) Foreign Application Priority Data

Sep. 10, 2007 (JP) ..... 2007-234023

(51) Int. Cl.
*A63B 53/10* (2006.01)
*A63B 53/12* (2006.01)

(52) U.S. Cl. ..... 473/320

(58) Field of Classification Search ..... 473/316–323
See application file for complete search history.

(56) References Cited

U.S. PATENT DOCUMENTS

| | | | | |
|---|---|---|---|---|
| 4,725,060 | A * | 2/1988 | Iwanaga | 473/289 |
| 5,071,687 | A * | 12/1991 | Shigetoh | 428/35.9 |
| 6,306,047 | B1 * | 10/2001 | Kusumoto | 473/319 |
| 6,514,156 | B1 * | 2/2003 | Zorzi | 473/319 |
| 6,533,677 | B1 * | 3/2003 | Sumitomo et al. | 473/316 |
| 6,709,347 | B1 * | 3/2004 | Ono et al. | 473/319 |
| 6,860,821 | B2 * | 3/2005 | Unosawa et al. | 473/320 |
| 2002/0082112 | A1 * | 6/2002 | Unosawa et al. | 473/318 |
| 2004/0009827 | A1 * | 1/2004 | Oyama | 473/319 |
| 2005/0255935 | A1 * | 11/2005 | Yanagisawa et al. | 473/316 |
| 2007/0105644 | A1 * | 5/2007 | Kumamoto | 473/316 |
| 2008/0026868 | A1 * | 1/2008 | Takeuchi | 473/319 |

FOREIGN PATENT DOCUMENTS

| | | | |
|---|---|---|---|
| JP | 62 94182 | | 4/1987 |
| JP | 2 188232 | | 7/1990 |
| JP | 10179826 | A * | 7/1998 |
| JP | 3070038 | | 7/2000 |
| JP | 2000 300704 | | 10/2000 |
| JP | 2000 325512 | | 11/2000 |
| JP | 2001 341126 | | 12/2001 |
| JP | 2002 191735 | | 7/2002 |
| JP | 2004057673 | A * | 2/2004 |

* cited by examiner

*Primary Examiner* — Stephen L. Blau
(74) *Attorney, Agent, or Firm* — Oblon, Spivak, McClelland, Maier & Neustadt, L.L.P.

(57) ABSTRACT

A shaft for a golf club comprises a plurality of fiber-reinforced resin layers. A plurality of circumferentially oriented metal wires are provided at intervals of 1 mm to 4 mm in an axial direction of the shaft having a length in an axial direction of more than 100 mm and less than 300 mm and being centered at a position of $3.25\times10^2$ mm from a larger-diameter end of the shaft.

5 Claims, 8 Drawing Sheets

SHAFT FOR GOLF CLUB

TECHNICAL FIELD

The present invention relates to a shaft for a golf club.

The present application claims priority from Japanese Patent Application No. 2007-234023, filed on Sep. 10, 2007, the contents of which are hereby incorporated by reference into this application.

BACKGROUND ART

In order to improve the flying distance of a hit ball in golf, the use of a long-sized golf club which has a long shaft for golf club is effective. Hereinafter, the "shaft for golf club" is referred to as a "shaft". If the long-sized golf club is used, the head speed is increased at the time of the swing of the golf club; therefore, the flying distance is extended.

However, if a long-sized golf club is used, since the position the ball is hit in is distant from the grip when compared with a golf club of a common length, there is a problem in that the possibility of miss-hitting the ball increases.

Recently, for the purposes of solving the miss-hitting by the long-sized golf club, a long-sized golf club mounted with a large-sized golf club head having a volume of over 400 cc (hereinafter, referred to as a large head) has appeared and been established in the market (see Patent Document 1). If a long-sized golf club mounted with a large head is used, moment of inertia of the head is increased and the directivity of the hit ball. In addition, since the large head has a large sweet spot, the miss-hitting is reduced. Moreover, since the large head provides the user with a visual sense of ease, the user can execute their swing in a more relaxed state compared with a case of using a conventional long-sized golf club, thereby reducing the miss-hitting.

However, compared with a conventional head, the mass of the large head has been increasing. Further, if the length of the shaft is simply lengthened, the mass of the shaft increases with the extended length. Therefore, the mass of the whole golf club increases by assembling such a lengthened shaft to the large head, and thus the moment of inertia of the whole golf club increases. Since it is difficult to swing such a golf club, swing speed decreases, and the flying distance of the ball may be shortened.

In order to suppress the increase in moment of inertia of the whole golf club in the long-sized golf club mounted with the large head, it is necessary to suppress the increase in the mass of the shaft. However, if the increase in the mass of the shaft is suppressed and the thickness of the shaft is also reduced in order to extend its length, the rigidity of the shaft is lowered, and a deformation amount of the shaft then increases when hitting the ball, thereby its controllability deteriorates. Consequently, the directivity of the hit ball becomes prone to variation.

In order to solve the above problems, a golf club including a shaft having a first outer diameter of 16.5 mm or more which is extended to 100 mm from the grip side end is disclosed (see Patent Document 2). By setting the first outer diameter of the shaft as the above size, it is possible to suppress bending deformation and torsional deformation in the shaft.

[Patent Document 1] Japanese Unexamined Patent Application, First Publication No. 2000-325512

[Patent Document 2] Japanese Unexamined Patent Application, First Publication No. 2000-300704

DISCLOSURE OF INVENTION

Problem to be Solved by the Invention

However, according to the golf club disclosed in Patent Document 2, since the increase in the weight is suppressed and the outer diameter of the shaft is increased, the thickness of the shaft is thinned. A "crush deformation amount", in which the cross section of the shaft is crushed into an oval shape at the time of hitting the ball, tended to rather increase. Consequently, it is not possible to sufficiently reduce the deformation amount of the shaft. Further, there is a problem in that since the grip is thicker than a conventional golf club, there are many players who are bothered by a sense of discomfort.

The present invention is contrived taking the above circumstances into consideration, and an object of the present invention is to provide a shaft for a golf club which can reduce the crush deformation amount, suppress increases in the weight of the shaft, improve the flying distance of a hit ball, and reduce variations in the directivity of the hit ball, even though the length of the shaft is extended.

Means for Solving Problem

In order to solve the above problem, the present invention employs the following configuration.

A shaft for a golf club of the present invention comprises a plurality of fiber-reinforced resin layers and a plurality of circumferentially oriented metal wires are provided at intervals of 1 mm to 4 mm in an axial direction at such a portion of the shaft having a length in an axial direction of more than 100 mm and less than 300 mm and being centered at a position of $3.25\times10^2$ mm from a larger-diameter end of the shaft.

The plurality of circumferentially oriented metal wires may be provided at intervals of 1 mm to 4 mm in an axial direction at such a portion of the shaft having a length in an axial direction of more than or equal to 160 mm and less than or equal to 240 mm and being centered at a position of $3.25\times10^2$ mm from the larger-diameter end of the shaft.

The plurality of circumferentially oriented metal wires may be provided at intervals of 1 mm to 4 mm in an axial direction at such a portion of the shaft having a length in an axial direction of 240 mm and being centered at a position of $3.25\times10^2$ mm from the larger-diameter end of the shaft.

The metal wire may have a flat cross section, a maximum thickness of 17 μm to 25 μm, and a width of 180 μm to 280 μm.

The metal wire may be an amorphous metal wire having tensile strength of 200 to 400 kgf/mm$^2$, a degree of elongation of 1 to 3.5%, and Young's modulus of 14000 to 17000 kgf/mm$^2$.

Further, the shaft for the golf club of the present invention is constituted of a plurality of fiber-reinforced resin layers, and is characterized by satisfying the following conditions (A) to (C):

(A) bending rigidity of a portion of 125 to 175 mm from the larger-diameter end of the shaft is $5.7\times10^6$ kgf·mm$^2$ or less;

(B) bending rigidity of a portion of 225 to 275 mm from the larger-diameter end of the shaft is $5.3\times10^6$ kgf·mm$^2$ or more; and (C) when a test piece having a width of 20 mm which is a portion of 345 mm to 365 mm from the larger-diameter end of the shaft is cut from the shaft, and then a compression load is applied to the test piece, crush-deformation resistance calculated from a straight portion of a load-deformation graph is 2.3 to 2.6 kgf/mm$^2$.

Effect of the Invention

According to the shaft for a golf club of the present invention, there is provided a golf club in which even though the length of the shaft is extended, since the crush deformation amount is reduced and the increase in weight of the shaft is suppressed, swing speed can be increased to improve the flying distance when hitting a ball, and the controllability can be enhanced to reduce variations in directivity of the hit ball.

DESCRIPTION OF THE REFERENCE NUMERALS

| | |
|---|---|
| 1 | FIBER-REINFORCED RESIN LAYER |
| 2 | LARGER-DIAMETER END |
| 3 | REINFORCED PORTION |
| 4 | AXIS |
| 5 | METAL WIRE |
| 7, 8 | GLASS FIBER-REINFORCED RESIN LAYER |
| 10 | SHAFT FOR GOLF CLUB |

BEST MODE FOR CARRYING OUT THE INVENTION

An example of a shaft for a golf club according to the present invention will now be described.

Figure 1:
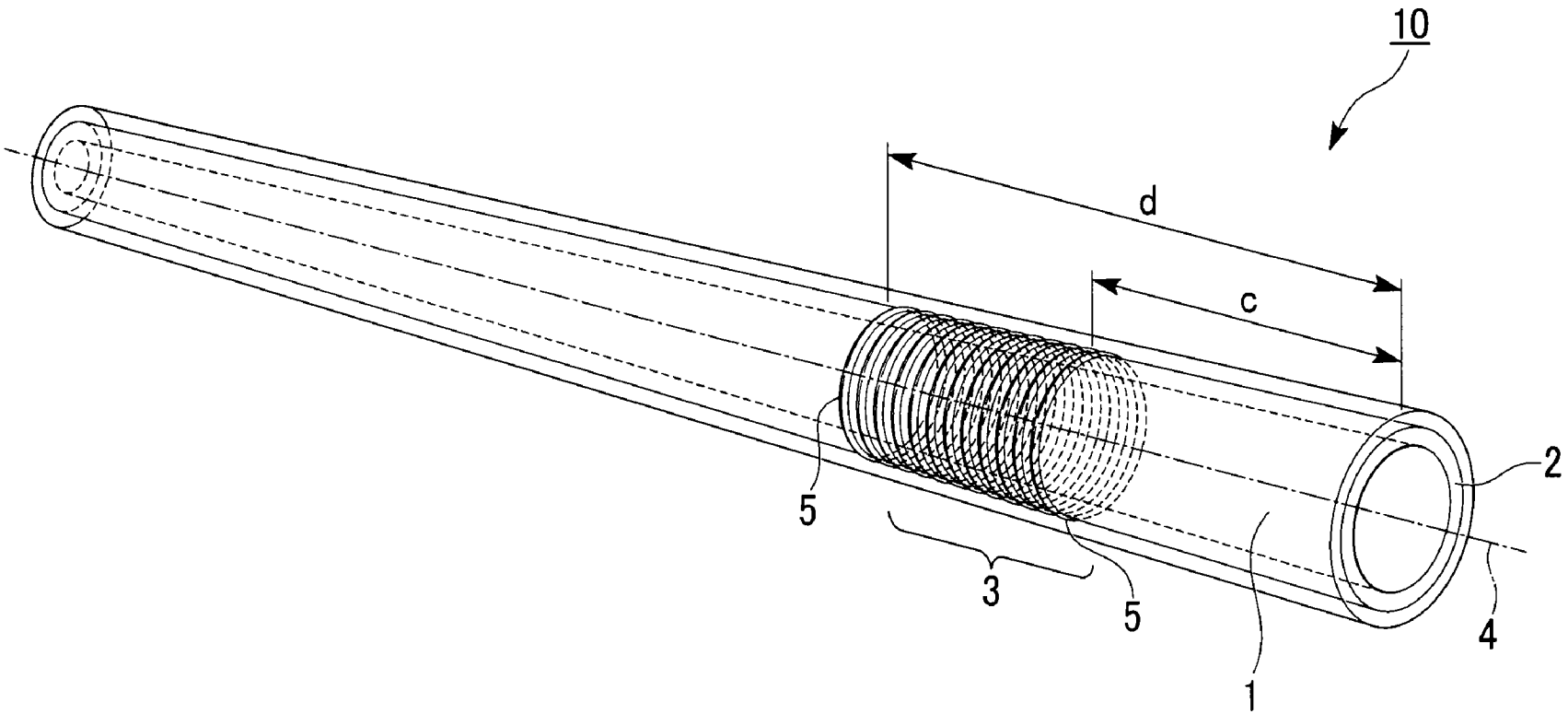
FIG. 1 is a perspective oblique view schematically illustrating an example of an embodiment of a shaft 10 for a golf club according to the present invention.
Figure 2:
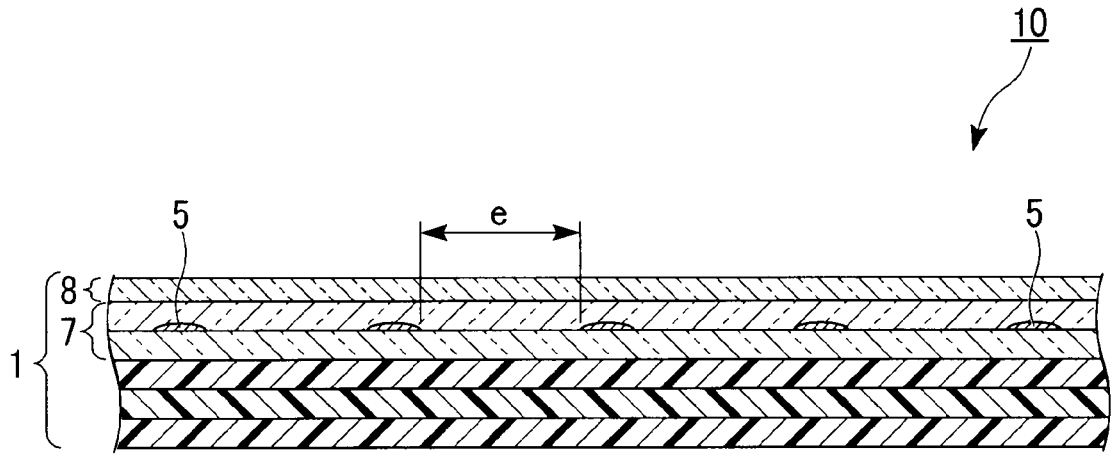
FIG. 2 is a partial cross-sectional view of a reinforced portion 3 of an example of the present invention.

As shown in FIG. 1, the shaft 10 for a golf club has a tubular structure, and the tubular structure is constituted of a plurality of fiber-reinforced resin layers 1. At a portion (hereinafter, referred to as a reinforced portion 3) extending from a distance c from a larger-diameter end 2 of the shaft 10 to a distance d from the larger-diameter end 2 of the shaft 10, a plurality of circumferentially oriented metal wires 5 (vertical to an axis 4 direction) are provided. As shown in FIG. 2, the metal wires 5 are provided spaced apart from adjacent metal wires 5 in an axial direction at an interval e so as not to contact with each other. The term 'larger-diameter end 2' means an end formed by winding prepreg around a cored mandrel to form a shaft tube, curing a resin in the prepreg, removing the cored mandrel, cutting both ends of the shaft tube by 10 mm to form a shaft having a whole length of 1170 mm, and then cutting the larger-end side of the shaft by 75 mm at the time of fabricating a golf club.

The distance c is preferably more than $1.75\times10^2$ mm and less than $2.75\times10^2$ mm, more preferably, $2.05\times10^2$ mm or more and $2.45\times10^2$ mm or less, even more preferably, $2.05\times10^2$ mm. The distance d is preferably more than $3.75\times10^2$ mm and less than $4.75\times10^2$ mm, more preferably, $4.05\times10^2$ mm or more and $4.45\times10^2$ mm or less, even more preferably, $4.45\times10^2$ mm. From the preferred range of the distance c and the distance d, the reinforced portion 3 is preferably more than $1.00\times10^2$ mm and less than $3.00\times10^2$ mm, more preferably $1.60\times10^2$ mm or more and $2.40\times10^2$ mm or less, even more preferably, $2.40\times10^2$ mm. The interval e of the adjacent metal wires 5 is preferably 1 mm or more and 4 mm or less.

The thickness of the fiber-reinforced resin layers 1 is not particularly limited, but is preferably from 0.5 mm to 3.5 mm. The thickness of each fiber-reinforced resin layer 1 is from about 0.01 mm to about 0.25 mm. The number of the layers forming the fiber-reinforced resin layer 1 is not particularly limited, but preferably is from 6 layers to 35 layers.

As a matrix resin constituting the fiber-reinforced resin layer 1, a thermoplastic resin or a thermosetting resin may be used.

As the thermoplastic resin, a polyamide-based resin, a polyacrylate-based resin, a polystyrene-based resin, a polyethylene-based resin, and a mixture resin thereof may be used. As the thermosetting resin, an epoxy-based resin, an unsaturated polyester-based resin, a phenol-based resin, a urea-based resin, a melamine-based resin, a diallyl phthalate-based resin, a urethane-based resin, a polyimide resin, and a mixture thereof may be used. Preferably, the thermosetting resin is used, and the epoxy-based resin is preferably used, since its curing shrinkage ratio is low and it has a high rigidity and a high toughness.

As the reinforced fiber constituting the fiber-reinforced resin layer 1, an inorganic fiber, such as metal fiber, boron fiber, carbon fiber, glass fiber, ceramic fiber, an aramid fiber, and other high-strength synthetic fibers are used. Since an inorganic fiber is lightweight and has high strength, an inorganic fiber is preferably used. Among them, the carbon fiber is more preferably used, because of its high specific strength and specific rigidity. These fibers may be used alone or in combination. Further, a different reinforced fiber may be used for every layer, and, for example, the fiber-reinforced resin layer 1 may be configured by combining a carbon fiber layer and a glass fiber layer. In addition, a fiber of any length, such as a long fiber, a short fiber or a fiber mixture thereof may be used.

As one example of the fiber-reinforced resin layer 1, as shown in FIG. 2, glass fiber layers 7 and 8 and a reinforced fiber layer other than glass fiber may be combined. The glass fiber layer 7 is made of two-layered glass fiber woven fabric.

As the metal wire 5, a piano wire, a stainless steel wire, a titanium wire, an amorphous metal wire or the like may be used. Preferably, the amorphous metal wire is used, and its composition is preferably Co/Fe/Cr/Si/B. The amorphous metal wire of such a composition has superior strength and a low degree of elongation, and little dimensional variation is produced at the fabrication. Further, it has the same corrosion resistance as that of an SUS304 stainless steel wire.

The metal wire 5 may have a true-circle or flat cross section, however a flat cross section is preferable. By making the cross section of the metal wire 5 flat, the thickness of the layer on which the metal wire is placed can be thinned. Therefore, when the metal wire 5 is placed on the outermost layer which has the most significant reinforcing effect, it does not interfere with the role of the other fiber-reinforced resin layer 1. Further, since the metal wire 5 having the flat cross section comes into surface contact with the resin or fiber of the fiber-reinforced resin layer 1, peeling resistance is enhanced.

In the case in which the metal wire 5 have a flat cross section, it has a cross section which is a convex and arch shape, and preferably has a maximum thickness of 17 μm to 25 μm and a width of 180 μm to 280 μm. The metal wire 5 having such a cross section can be easily cut at a cut step in the process of fabricating the shaft for the golf club, as compared with a true-circle metal wire having the same reinforcing effect, thereby enhancing the workability.

The metal wire 5 is preferably an amorphous metal wire having tensile strength of 200 to 400 kgf/mm$^2$, a degree of elongation of 1 to 3.5%, and Young's modulus of 14000 to 17000 kgf/mm$^2$. The metal wire 5 is advantageous as compared with metal wires outside of the range in view of interlayer adhesion, crush strength development, handling properties.

The reinforced portion 3 corresponds to a portion of the shaft for the golf club in which crush deformation is large. By disposing the plurality of metal wires 5 around the reinforced portion 3, it is possible to reduce the crush deformation in the reinforced portion 3.

The metal wire 5 may be positioned at any position between plural layers constituting the fiber-reinforced resin layer 1. It is preferable that the metal wire be positioned near the outermost layer, since it further enhances the reinforcing effect.

The metal wires 5 are circumferentially oriented at intervals e (1 mm to 4 mm) in the direction of axis 4 of the shaft 10 for the golf club. By setting the intervals of the metal wires to 5 to 4 mm or less, the sufficient reinforcing effect can be obtained. Further, by setting the intervals to 1 mm or more, it is possible to prevent the weight of the shaft 10 for the golf club from dramatically increasing. The interval e of the plurality of metal wires 5 may be an equal distance or different distance.

The displacement number of the metal wires 5 is varied according to the width of the metal wires 5, but 30 to 240 metal wires 5 are preferable. If 240 or less, it is possible to prevent the weight from dramatically increasing, and if 30 or more, the sufficient reinforcing effect for the crush deformation can be obtained.

The metal wires 5 are circumferentially oriented and placed. That is, the metal wire 5 is formed in a circular ring. The metal wires 5 are preferably formed in such a way that both ends thereof are coupled to each other in a ring shape, but it is not necessary to always couple both ends of the metal wires 5. A gap may be formed between both ends, and it may be formed in any arc shape having various degrees of arc (center angle).

Preferably, the metal wires 5 are interposed and disposed between two glass fiber reinforced resin layers 7 using glass fiber woven fabric as a reinforced fiber, as shown in FIG. 2. The glass fiber woven fabric has a moderate undulation on its surface. At the time of fabricating the shaft for the golf club, the undulation has a role of preventing the fixed metal wires 5 from being shifted, so that the intervals between the metal wires 5 are not changed.

As the glass fiber-woven fabric, the basis weight is preferably from 20 g/m$^2$ to 30 g/m$^2$. The woven fabric having the basis weight in such a range has undulation suitable for shift prevention of the metal wires 5.

A method of pinching the metal wires 5 between the glass fiber-reinforced resin layers 7 is not specially limited, but a method of arranging a plurality of metal wires 5 evenly, overlaying it with two-layered glass fiber woven fabrics which are previously impregnated with matrix resin, and inserting it between a pair of heated rollers to heat and compress it or a drum winding method disclosed in Japanese Unexamined Patent Application Publication No. 2001-341126 may be exemplified.

At the outer layer of the glass fiber reinforced resin layers 7, it is preferable that a glass fiber reinforced resin layer 8 having a glass fiber as a reinforced fiber be further formed. The glass fiber reinforced resin layer 8 can protect the glass fiber reinforced resin layers 7 from being scratched by grinding of the surface of the shaft tube, at a grinding process of the surface of the shaft tube when fabricating the shaft for the golf club.

In this instance, since the glass fiber reinforced resin layers 7 and 8 are transparent resin layers due to properties of the fiber, the metal wires 5 pinched in the glass fiber reinforced resin layer 7 can be visually recognized from outside. Since the shaft 10 for the golf club having such a configuration visually shows this feature of the golf club to a user through the visual recognition of the existence of the metal wires 5, it can form an excellent decorative design for a golf club.

As described above, in the shaft 10 for the golf club according to one embodiment of the present invention, since the plurality of circumferentially oriented metal wires 5 are disposed on the reinforced portion 3 at the interval e in the direction of the axis 4, even though the length of the shaft is extended, the increase in the weight of the shaft can be suppressed while the crush deformation is reduced. Therefore, according to the golf club using the shaft 10 for the golf club, since the increase in the moment of inertia of the whole golf club is suppressed, the swing speed can be enhanced, and thus the flying distance of the hit ball can be improved. Also, since the controllability is improved, it can reduce the variation in the directivity of the hit ball.

The configuration of the present invention is applied to a shaft for a so-called long-sized and lightweight golf club, of which the length is from 1143 mm to 1219 mm and the shaft has weight of 40 g to 75 g, thereby exhibiting the effect sufficiently.

The shaft 10 for the golf club of the present invention having the above features exhibits the maximum effect by combination of the large-sized head. As the large-sized head, a combination with the large-sized head having a volume of 380 cm$^3$ to 460 cm$^3$ and moment of inertia of 3500 g·cm$^2$ to 5900 g·cm$^2$ is preferable as the large-sized head. The shaft 10 for the golf club of the present invention can suppress the increase in the moment of inertia of the whole golf club, even though a large-sized head is mounted.

In the shaft 10 for the golf club of the present invention, it is preferable that bending rigidity of a portion of 125 to 175 mm from the larger-diameter end of the shaft be $5.7\times10^6$ kgf·mm$^2$ or less, and bending rigidity of a portion of 225 to 275 mm from the larger-diameter end of the shaft be $5.3\times10^6$ kgf·mm$^2$ or more.

The bending rigidity EI is measured by installing a fulcrum point (a radius of a support jig installed at the fulcrum point: 12.5 mm) at a position of 150 mm toward the larger-diameter end side and at a position of 150 mm toward a smaller-diameter end side with centering a measuring point, increasing a load to the measuring point (a radius of a load indenter jig installed at the measuring points: 75 mm), and measuring deformation $\delta_{10}$ (mm) and $\delta_{20}$ (mm) of the shaft when the load of 10 kgf and 20 kgf are applied, on the basis of the following equation. In the bending rigidity distribution, the bending rigidity EI was measured over the overall length whenever the measuring point is moved at a constant interval of 50 mm in a longitudinal direction of the shaft.

The bending rigidity EI can be obtained by using the following equation.

$$EI=(\Delta P/L^3)/(48\cdot\delta)$$

EI: bending rigidity (kgf·mm$^2$)

$\Delta P$: 20 kgf·10 kgf=10 kgf

L: distance (mm) between fulcrum points $\Delta\delta$: $\delta_{20}-\delta_{10}$ (mm)

In the shaft 10 for the golf club of the present invention, it is preferable that a test piece having a width of 20 mm which centers a position of 355 mm from the larger-diameter end 2 of the shaft 10 be cut, and a crush-deformation resistance (Rc) of the test piece be 2.3 to 2.6 kgf/mm$^2$. Regarding the value of the crush-deformation resistance (Rc), the test piece having the width of 20 mm which centers the position of 355 mm from the larger-diameter end 2 of the shaft 10 is cut, and then when compression load (P) is applied to the test piece in a direction perpendicular to the axial direction of the specimen, the deformation ($\Delta\lambda$) of the test piece is measured to prepare a graph of load P-deformation $\lambda$. At a straight portion of the graph, $\Delta P$ and $\Delta\lambda$ are obtained, and the crush-deformation resistance (Rc) is calculated by using the following equation.

$$Rc=\Delta P/(\Delta\lambda\times w)$$

Rc: crush-deformation resistance (kgf/mm$^2$)

$\Delta P$: load variations (kgf)

$\Delta\lambda$: crush deformation (mm)

w: width of test piece (20 mm)

In the shaft 10 for the golf club, it is preferable that the test piece having the width of 20 mm which centers the position of 355 mm from the larger-diameter end 2 of the shaft 10 be cut, and the crush-deformation resistance (Rc) of the test piece is 70 to 85 kgf.

The crush-deformation resistance (P3) is a load when the test piece is broken by applying the compression load to the test piece in a direction perpendicular to the axial direction of the test piece. The value of the crush-deformation resistance (P3) is obtained by measuring the load when the test piece is broken down by cutting the test piece having the width of 20 mm which centers the position of 355 mm from the larger-diameter end 2 of the shaft 10, and applying the compression load to the test piece in a direction perpendicular to the axial direction of the specimen.

In a specific position of the shaft 10 for the golf club, in the case in which the bending rigidity and the crush-deformation resistance are within the above-described numerical range, since it is possible to reduce the deformation of the shaft at the time of hitting the ball and appropriate bending can be obtained, the controllability of the golf club can be obtained, and thus the variation in the directivity of the hit ball can be reduced. Even though the length of the shaft is extended, the same effect can be obtained. In addition, in the case in which the crush-deformation resistance is within the numerical range, the effect is further improved.

In the case in which the bending rigidity and the crush-deformation resistance are not within the above-described numerical range, since the deformation of the shaft is not reduced, it is difficult to improve the controllability of the golf club and reduce the variations in the directivity of the hit ball.

EXAMPLES

Next, the present invention will be described in detail on the basis of Examples.

The materials of the shaft for the golf club fabricated in Example 1 and Comparative Example 1 are shown below.

Prepreg A: carbon fiber prepreg MR350C100S (thickness of 0.084 mm, manufactured by Mitsubishi Rayon Co., Ltd.)

Prepreg B: carbon fiber prepreg TR350E125S (thickness of 0.113 mm, manufactured by Mitsubishi Rayon Co., Ltd.)

Prepreg C: carbon fiber prepreg MR350C150S (thickness of 0.127 mm, manufactured by Mitsubishi Rayon Co., Ltd.)

Prepreg D: glass fiber prepreg GE352G135S (thickness of 0.111 mm, manufactured by Mitsubishi Rayon Co., Ltd.)

Glass fiber-woven fabric prepreg: WPA 03104 EGE (prepreg made by impregnating a woven fabric of a plain fabric having fabric density of weft of 60/25 mm and waft of 51/25 mm, in which the warp and the weft were glass fiber ECD 900 1/0 manufactured by Nitto Boseki Co., Ltd., with epoxy resin composition; resin content rate of 26 wt %, manufactured by Nitto Boseki Co., Ltd.)

Metal wire: amorphous metal fiber Bolfur flat wire 75FE10 (composition: Co/Fe/Cr/Si/B, shape: a cross section of a shape which is bent at an intermediate height, like a bow with the maximum thickness of 17 to 25 μm and the width of 180 to 280 μm; manufactured by Unitika Limited)

Example 1

<Manufacture of Glass Fiber-Woven Fabric Prepreg with Metal Wires Interposed Therebetween>

Figure 3:
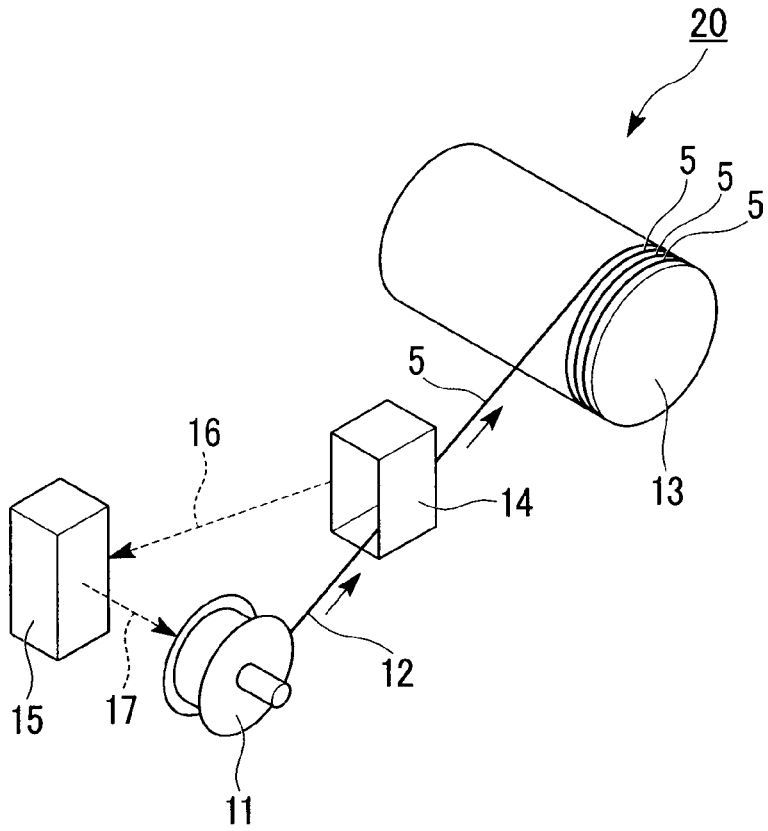
FIG. 3 is a conceptual diagram of a drum winding device 20 used at fabrication of a metal wire prepreg in an example of the present invention.

By using the drum winding device 20 shown in FIG. 3, a prepreg with the metal wires interposed therebetween was manufactured (see a drum winding method disclosed in Japanese Unexamined Patent Application, First Publication No. 2001-341126). The drum winding device 20 includes an unwinding bobbin 11 rotating and drawing out the metal wire 5 and a drum 13 for winding the metal wire 5 drawn out from the unwinding bobbin 11. Further, the drum winding device 20 includes a detector 14, disposed between the unwinding bobbin 11 and the drum 13, for detecting tension applied to the metal wire 5, and a brake 15 for controlling the rotational speed of the unwinding bobbin 11 based on measured data of the tension detected by the detector 14. In addition, the drum winding device 20 includes a signal line 16 for transferring the measured data of the tension detected by the detector 14 to the brake 15, and a signal line 17 connecting the brake 15 and the unwinding bobbin 11 and transferring a control signal from the brake 15 to the unwinding bobbin 11. In this way, by controlling the rotational speed of the unwinding bobbin 11, the tension applied to the metal wire 5 is adjusted.

By using the drum winding device 20, the glass fiber woven fabric prepreg was wound around the drum 13 in such a way that the warp is disposed in a circumferential direction of the drum 13. Next, the metal wires 5 were wound on the glass fiber woven fabric prepreg at an interval of 2 mm. The winding angle of the metal wires 5 was about 90 degrees with respect to the axial direction of the drum 13. The tension applied to one metal wire 5 was 90 to 110 gf/metal wire.

Next, the glass fiber woven fabric prepreg wound with the metal wires 5 was pressed by a rubber roller (not shown) to pressurize the metal wires 5 and the glass fiber woven fabric prepreg. It was detached from the drum 13, so that the prepreg, in which the metal wires 5 were disposed on the glass fiber woven fabric prepreg, was obtained.

Another sheet of separately prepared glass fiber woven fabric prepregs was adhered to the surface of the glass fiber-woven fabric prepreg, on which the metal wires 5 are disposed, in such a way that the warp direction of the two sheets of glass fiber-woven fabric prepregs intersects at 90 degrees. Two sheets of glass fiber-woven fabric prepregs were compressed by applying a cylinder pressure of 4.0 kgf/cm$^2$ at a temperature of 68° C. by using a fusing press (manufactured by Nambu Iron works Co., Ltd.) to obtain the glass fiber-woven fabric prepreg with the metal wire interposed therebetween (hereinafter, referred to as 'metal wire prepreg').

<Cutting and Winding of Prepreg>

Figure 4:
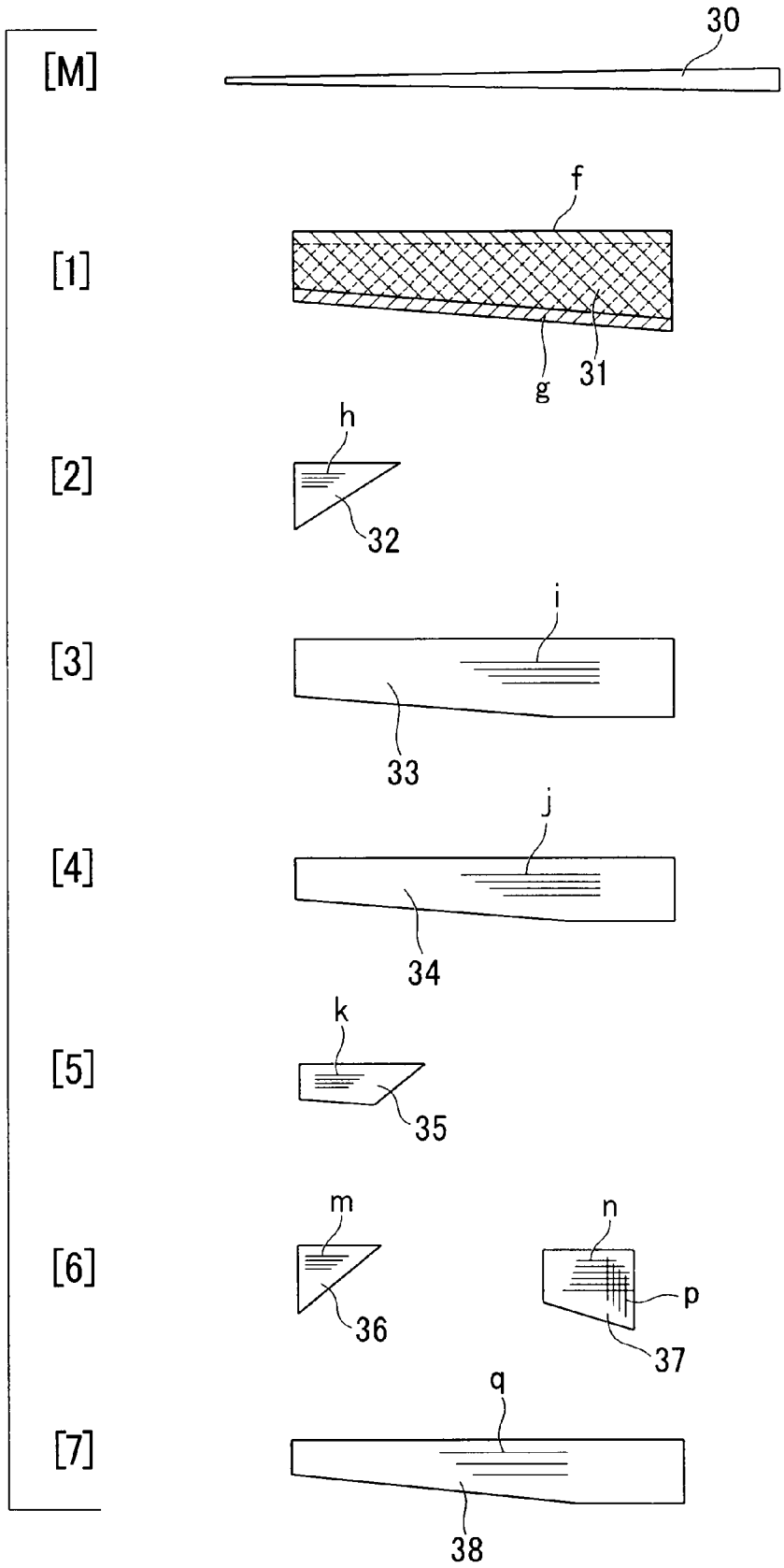
FIG. 4 is a view illustrating a cutting shape of a prepreg used at fabrication of a shaft for a golf club in Example 1, and an order of winding the prepreg around a cored mandrel 30.

The prepregs 31 and 33 were obtained by cutting the prepreg A in the shapes indicated by [1] and [3] in FIG. 4. In this instance, the prepreg 31 was formed by attaching two sheets of prepregs A, which were cut to have the same size, in such a way that the fiber direction intersects each other at an angle of 90 degrees, as indicated by f and g, in the state in which joint positions were slightly deviated from each other. In the prepreg 33, the fiber direction was set in a direction indicated by i.

The prepreg B was cut in the shape shown in left sides of [2], [5] and [6] in FIG. 4 to obtain the prepregs 32, 35 and 36. In the prepreg 32, the fiber direction was set in a direction indicated by h. In the prepreg 35, the fiber direction was set in a direction indicated by k. In the prepreg 36, the fiber direction was set in a direction indicated by m.

The prepreg C was cut in the shape shown in [4] in FIG. 4 to obtain the prepreg 34. In the prepreg 34, the fiber direction was set in a direction indicated by j.

The prepreg D was cut in the shape shown in [7] in FIG. 4 to obtain the prepreg 38. In the prepreg 38, the fiber direction was set in a direction indicated by q.

The metal wire prepreg manufactured by the above was cut in the shape shown in a right side of [6] in FIG. 4 to obtain the prepreg 37. In the prepreg 37, the fiber direction was set in directions indicated by n and p. Further, the metal wire 5 was interposed along the direction shown by p.

Next, the prepregs 31 to 38 were wound around the portion of 120 mm to 1310 mm from a smaller-diameter end of a cored mandrel 30 shown in [M] in FIG. 4 in the order of [1] to [7]. In this instance, as the cored mandrel 30, one having an overall length of 1450 mm, a smaller-diameter end having a diameter of 3.3 mm, a larger-diameter end having a diameter of 13.0 mm was used, in which a portion of 950 mm from the smaller-diameter end to the larger-diameter end side had a diameter of 12.8 mm and a portion of 1250 mm from the smaller-diameter end to the larger-diameter end side had a diameter of 13.0 mm. Further, the prepreg 37 (sheet cut from the metal wire prepreg) was wound to be $2.9\times10^2$ mm to $5.3\times10^2$ mm which is measured from the larger-diameter end of the shaft for the golf club.

Next, polypropylene tape (not shown) having a heat-shrinkable property of 20 μm at a width of 30 mm was wound and fixed on the surface of the prepreg wound around the cored mandrel 30 at a winding pitch of 2 mm to obtain a shaft tube formed on the cored mandrel 30.

<Curing of Resin and Grinding of Surface of Shaft Tube>

After the shaft tube was put in a curing furnace and then was heated at a temperature of 145° C. over 2 hours to perform the curing process of the resin of the prepreg, the polypropylene tape and the cored mandrel 30 were removed. Both ends of the obtained shaft tube for a golf club were cut by 10 mm, thereby obtaining a shaft having the overall length of 1170 mm, in which the metal wires 5 were disposed at $2.8\times10^2$ mm to $5.2\times10^2$ mm from the larger-diameter end of the shaft.

The shaft tube for the golf club was subjected to surface finishing using a cylindrical grinding machine so that the outer diameter of the smaller-diameter end was 8.50 mm and a cantilever flex was 162 mm, thereby obtaining the shaft for the golf club according to Example 1.

<Attaching of Golf Club Head and Grip>

A titanium golf club head (a volume of 430 cm$^3$, weight of 203 g and a loft angle of 10.5°), which was commercially available, for a driver was attached to the smaller-diameter end of the shaft for the golf club according to Example 1 by using epoxy resin adhesive. In addition, the larger-diameter end of the shaft was cut by 75 mm to obtain the shaft with the metal wire 5 disposed at $2.05\times10^2$ to $4.45\times10^2$ mm. A commercially available rubber grip was attached to the shaft by using a double-sided tape to obtain the golf club in Example 1.

<Evaluation of Hitting Ball>

Feeling evaluation was performed by 5 testers a to e (two professional players and three upper grade amateurs) in which they hit a golf ball with the golf club according to Example 1. The feeling evaluation was a combined evaluation of three viewpoints on (1) ease of swing, (2) ease in capturing of timing, and (3) whether the bending state is a desired one. Comparative Example 1 was set to '3' to be indicated as a comparative evaluation.

5: very excellent
4: excellent
3: normal like Comparative Example 1
2: inferior
1: very inferior Table 5 below shows evaluation results.

In addition, when 5 testers hit the golf ball by the golf club according to Example 1, measurement of flying distance and right and left deviation was performed by using 'TrackMan' (manufactured by Interative Sports Games) (input by 43 m/s as the head speed and supposed that the hit point was adjacent to the center portion of the head). The measurement was performed by hitting three times with the exception of missed shots. As a result, an average flying distance (carry) was 222.3 yrd, a variation of the flying distances was ±3.6 yrd, and the right and left deviation was ±8.2 yrd, so that the flying distance and the directivity were excellent.

Comparative Example 1

The golf club according to Comparative Example 1 was obtained by the same method as Example 1, except that the winding sheet 37 (sheet cut by the metal wire prepreg in predetermined dimensions) was not wound.

Figure 5:
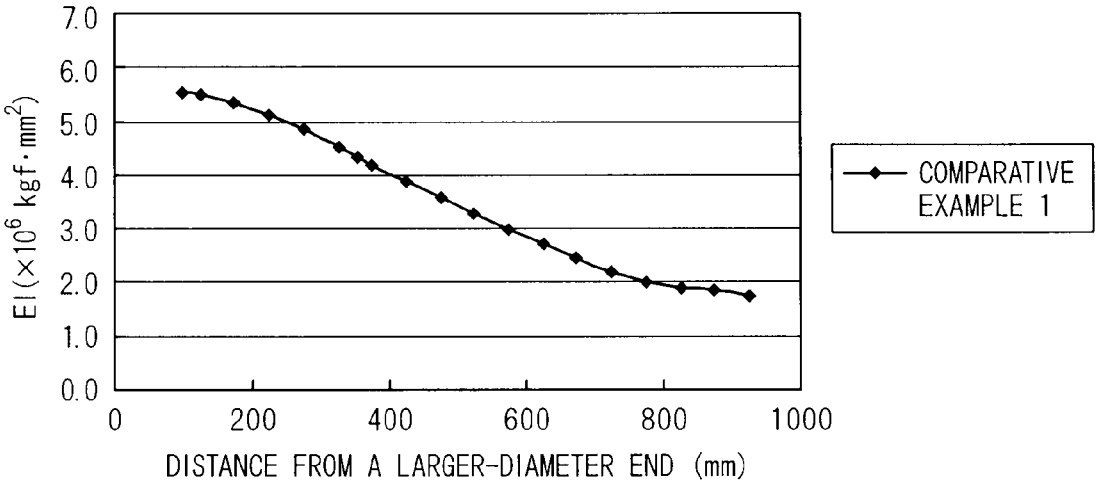
FIG. 5 is an EI distribution illustrating a relation between bending rigidity EI value and a distance from a larger-diameter end of a shaft for a golf club in Comparative Example 1.

With respect to the shaft for the golf club according to Comparative Example 1, bending rigidity, the crush-deformation resistance, and crush withstand load were measured. The measured results are shown in Table 3 below. The bending rigidity (EI values) measured whenever the measuring point was moved to a position of 100 mm to a position 925 mm from the larger-diameter end of the shaft for the golf club at an interval of 50 mm in a longitudinal direction of the shaft is shown in Table 4 below. Further, FIG. 5 shows EI distribution illustrating a relation between EI values and a distance from the larger-diameter end of the shaft.

By using the golf club according to Comparative Example 1, the feeling evaluation, the flying distance evaluation and the right and left deviation evaluation were performed by the same method as Example 1. The result of the feeling evaluations are shown in Table 5 below. An average flying distance (carry) was 217.1 yrd, a variation of the flying distances was ±6.2 yrd, and the right and left deviation was ±13.4 yrd, so that the flying distance and the directivity were behind those of Example 1.

Examples 2 to 4 and Comparative Examples 2 to 7

The materials of the shaft for the golf club fabricated in Examples 2 to 4 and Comparative Examples 2 to 7 are shown below.

Prepreg A: carbon fiber prepreg TR350E125S (thickness of 0.113 mm, manufactured by Mitsubishi Rayon Co., Ltd.)

Glass fiber-woven fabric prepreg: WPA 03 104 EGE (prepreg made by impregnating a woven fabric of a plain fabric having fabric density of weft of 60/25 mm and waft of 51/25 mm, in which the warp and the weft were glass fiber ECD 900 1/0 manufactured by Nitto Boseki Co., Ltd., with epoxy resin composition; resin content rate of 26 wt %, manufactured by Nitto Boseki Co., Ltd.)

Metal wire: amorphous metal fiber Bolfur flat wire 75FE10 (composition: Co/Fe/Cr/Si/B, shape: a cross section of a shape which is bent at an intermediate height, like a bow with the maximum thickness of 17 to 25 μm and the width of 180 to 280 μm; manufactured by Unitika Limited)

The glass fiber woven fabric prepreg (metal wire prepreg) with the metal wires interposed therebetween was manufactured by the same method as Example 1.

<Cutting and Winding of Prepreg>

The prepregs 41, 43, 44, 45 and 46 were obtained by cutting the prepreg A in the shapes indicated in [1], [2], [3], [4], [5] and [6] in FIG. 4. In this instance, the prepreg 41 was formed by attaching two sheets of prepregs A, which were cut to have the same size, in such a way that its fiber direction intersects each other at an angle of 90 degrees, as indicated by f and g, in the state in which joint positions were slightly deviated from each other. In the prepreg 43, the fiber direction was set in a direction indicated by i. In the prepreg 44, the fiber direction was set in a direction indicated by j. In the prepreg 45, the fiber direction was set in a direction indicated by k. In the prepreg 46, the fiber direction was set in a direction indicated by m.

The metal wire prepreg manufactured by the above was cut in the shape shown in a right side of [6] in FIG. 4 to obtain the prepreg 47 (metal wire prepregs A-1, A-2, A-3, A-4, B, C, D, E, and F) shown in Table 1. In the prepreg 47, the fiber direction was set in directions indicated by n and p. Further, the metal wire 5 was interposed along the direction shown by p.

In Example 2, the metal wire prepreg A-1 in Table 1 was used, in Example 3, the metal wire prepreg B was used, in Example 4, the metal wire prepreg A-2 was used, in Comparative Example 2, the metal wire prepreg C in Table 2 was used, in Comparative Example 3, the metal wire prepreg D was used, in Comparative Example 4, the metal wire prepreg E was used, in Comparative Example 5, the metal wire prepreg F was used, in Comparative Example 6, the metal wire prepreg A-3 was used, and in Comparative Example 7, the metal wire prepreg A-4 was used. In Comparative Example 1, the prepreg 47 was not used.

TABLE 1

| | Example 2 | Example 3 | Example 4 |
|---|---|---|---|
| Kind of metal wire prepreg | A-1 | B | A-2 |
| Existence of metal wire | present | present | present |
| Width of metal wire (μm) | 180-280 | 180-280 | 180-280 |
| Interval of metal wires (mm) | 2 | 4 | 4 |
| Width of metal prepreg (mm) | 240 | 240 | 160 |
| Placed position of metal prepreg (distance from larger-diameter end) (mm) | 205-445 | 205-445 | 245-405 |
| Orientation angle of metal wire (°) | 90 | 90 | 90 |

TABLE 2

| | Comparative Example | | | | | | |
|---|---|---|---|---|---|---|---|
| | 1 | 2 | 3 | 4 | 5 | 6 | 7 |
| Kind of metal wire prepreg | — | C | D | E | F | A-3 | A-4 |
| Existence of metal wire | absent | present | present | present | present | present | present |
| Width of metal wire (μm) | — | 180-280 | 180-280 | 180-280 | 360-560 | 180-280 | 180-280 |
| Interval of metal wires (mm) | — | 6 | 2 | 4 | 4 | 2 | 2 |
| Width of metal prepreg (mm) | — | 240 | 240 | 240 | 240 | 300 | 100 |
| Placed position of metal prepreg (distance from larger-diameter end) (mm) | — | 20-445 | 205-445 | 205-445 | 205-445 | 175-445 | 275-375 |
| Orientation angle of metal wire (°) | — | 90 | <90 | <90 | 90 | 90 | 90 |

The glass fiber woven fabric prepreg was cut in the shape shown in [7] in FIG. 4 to obtain the prepreg 48.

Next, the prepregs 41, 43, 44, 45, 46, 47 and 48 were wound around the portion of 75 mm to 1265 mm from a smaller-diameter end of a cored mandrel 30 shown in [M] in FIG. 4 in the order of [1] to [7]. In this instance, as the cored mandrel 30, one having an overall length of 1500 mm, a smaller-diameter end having a diameter of 5.0 mm and a larger-diameter end having a diameter of 13.5 mm was used, in which a portion of 1000 mm from the smaller-diameter end to the larger-diameter end side had a diameter of 13.5 mm. Further, the prepreg 47 (sheet cut from the metal wire prepreg) was wound to be $2.9\times10^2$ mm to $5.3\times10^2$ mm which is measured from the larger-diameter end of the shaft of the golf club.

Next, polypropylene tape (not shown) having a heat-shrinkable property of 20 μm at a width of 30 mm was wound and fixed on the surface of the prepreg wound around the cored mandrel 30 at a winding pitch of 2 mm to obtain a shaft tube formed on the cored mandrel 30.

<Curing of Resin and Grinding of Surface of Shaft Tube>

After the shaft tube was put in a curing furnace and then was heated to a temperature of 145° C. for 2 hours to perform the curing process of the resin of the prepreg, the polypropylene tape and the cored mandrel 30 were removed. Both ends of the obtained shaft tube for a golf club were cut by 10 mm, thereby obtaining a shaft having the overall length of 1170 mm, in which the metal wires 5 were disposed at $2.8\times10^2$ mm to $5.2\times10^2$ mm from the larger-diameter end of the shaft.

The shaft tube for the golf club was subjected to surface finishing using a cylindrical grinding machine so that the outer diameter of the smaller-diameter end was 8.50 mm and a cantilever flex was 192 mm, thereby obtaining the shafts for the golf club according to Examples 2 to 4 and Comparative Examples 2 to 7.

With respect to the shaft for the golf clubs according to Examples 2 to 4 and Comparative Examples 2 to 7, bending rigidity, the crush-deformation resistance, and crush withstand load were measured. The measured results are shown in Table 3.

In Comparative Examples 1 to 7, the crush-deformation resistance was less than 2.3 kgf/mm$^2$ or more than 2.6 kgf/mm$^2$, the bending rigidity of the portion of 125 to 175 mm from the larger-diameter end of the shaft was more than $5.7\times10^6$ kgf·mm$^2$, and the bending rigidity of the portion of 225 to 275 mm from the larger-diameter end of the shaft was less than $5.3\times10^6$ kgf·mm$^2$. By contrast, in Examples 2 to 4, the crush-deformation resistance was 2.3 kgf/mm$^2$ or more and 2.6 kgf/mm$^2$ or less, the bending rigidity of the portion of 125 to 175 mm from the larger-diameter end of the shaft was more than $5.7\times10^6$ kgf·mm$^2$ or less, and the bending rigidity of the portion of 225 to 275 mm from the larger-diameter end of the shaft was $5.3\times10^6$ kgf·mm$^2$ or more.

<Attaching of Golf Club Head and Grip>

A titanium golf club head (a volume of 460 cm$^3$, weight of 195 g and a loft angle of 9.0°), which was commercially available, for a driver was attached to the smaller-diameter end of the shaft for the golf club according to Example 1 by using epoxy resin adhesive. In addition, the larger-diameter end of the shaft was cut by 75 mm to obtain the shaft with the metal wire 5 disposed at $2.05\times10^2$ to $4.45\times10^2$ mm. A commercially available rubber grip was attached to the shaft by using a double-sided tape to obtain the golf clubs in Examples 2 to 4 and Comparative Examples 2 to 7.

Conditions of the golf clubs are as follows:

Club length: 45.2 inches (1148 mm)

Club weight in total: 300 g

TABLE 3

| | Ex. 2 | Ex. 3 | Ex. 4 | Comp Ex. 1 | Comp Ex. 2 | Comp Ex. 3 | Comp Ex. 4 | Comp Ex. 5 | Comp Ex. 6 | Comp Ex. 7 |
|---|---|---|---|---|---|---|---|---|---|---|
| Load variation ΔP (kgf) | 71.3 | 70.9 | 74.4 | 40.0 | 71.2 | 66.2 | 64.5 | 72.7 | 77.7 | 68.0 |
| Time (sec) | 42 | 44 | 48 | 41 | 42 | 43 | 41 | 34 | 47 | 44 |
| Crush deformation Δλ (mm) | 1.40 | 1.47 | 1.60 | 1.37 | 1.40 | 1.43 | 1.37 | 1.13 | 1.57 | 1.47 |
| Width of test piece (mm) | 20 | 20 | 20 | 20 | 20 | 20 | 20 | 20 | 20 | 20 |
| Crush-deformation resistance Rc (kgf/mm$^2$) | 2.55 | 2.42 | 2.33 | 1.46 | 2.26 | 2.24 | 2.28 | 3.21 | 2.48 | 2.32 |
| Crush withstand load (kgf) | 71.4 | 70.9 | 74.4 | 65.9 | 73.2 | 68.2 | 65.7 | 86.9 | 78.0 | 77.5 |

Figure 6:
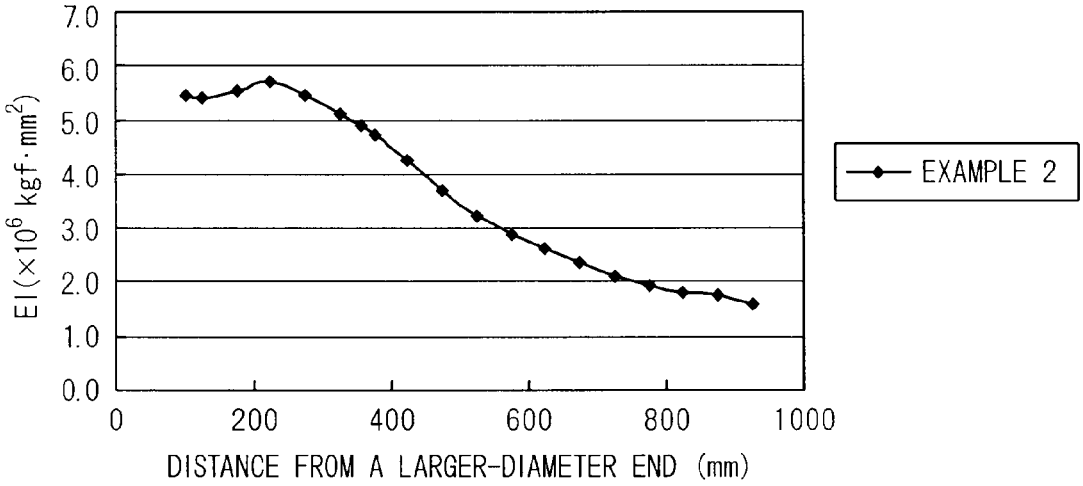
FIG. 6 is an EI distribution illustrating a relation between bending rigidity EI value and a distance from a larger-diameter end of a shaft for a golf club in Example 2.
Figure 7:
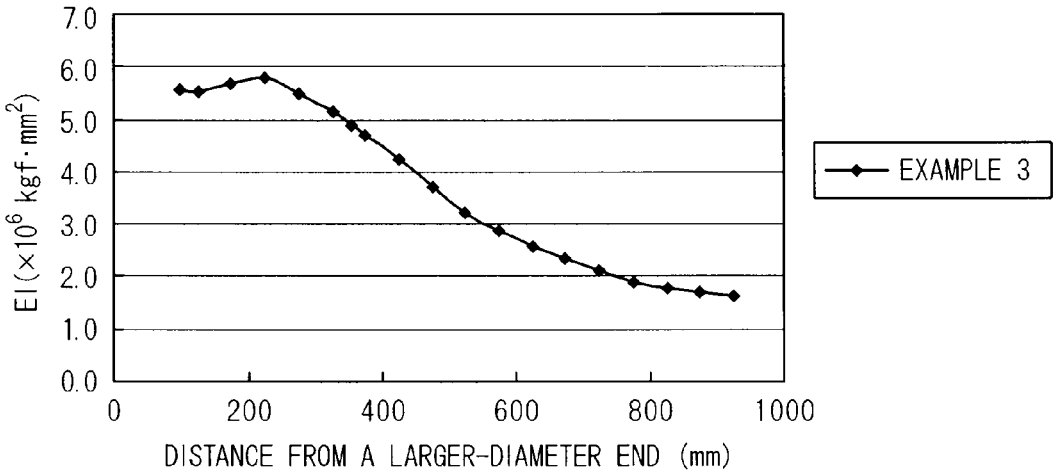
FIG. 7 is an EI distribution illustrating a relation between bending rigidity EI value and a distance from a larger-diameter end of a shaft for a golf club in Example 3.
Figure 8:
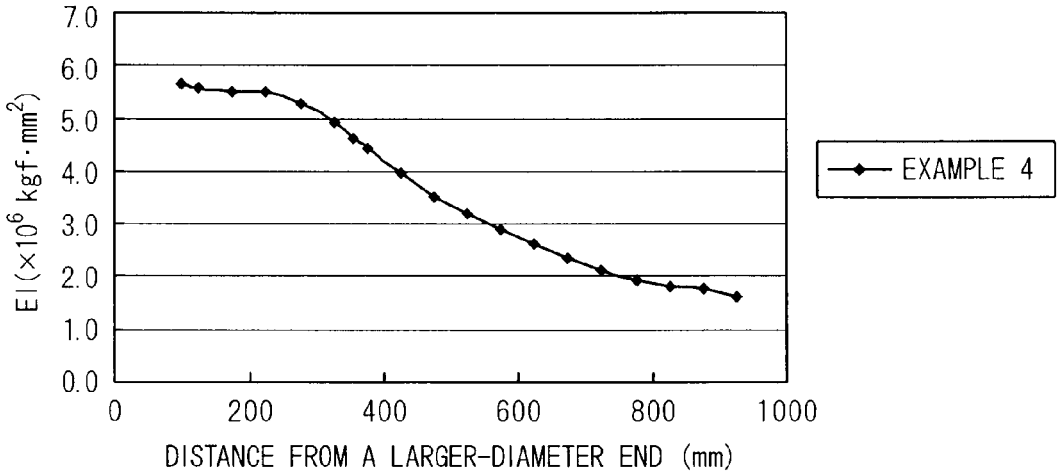
FIG. 8 is an EI distribution illustrating a relation between bending rigidity EI value and a distance from a larger-diameter end of a shaft for a golf club in Example 4.
Figure 9:
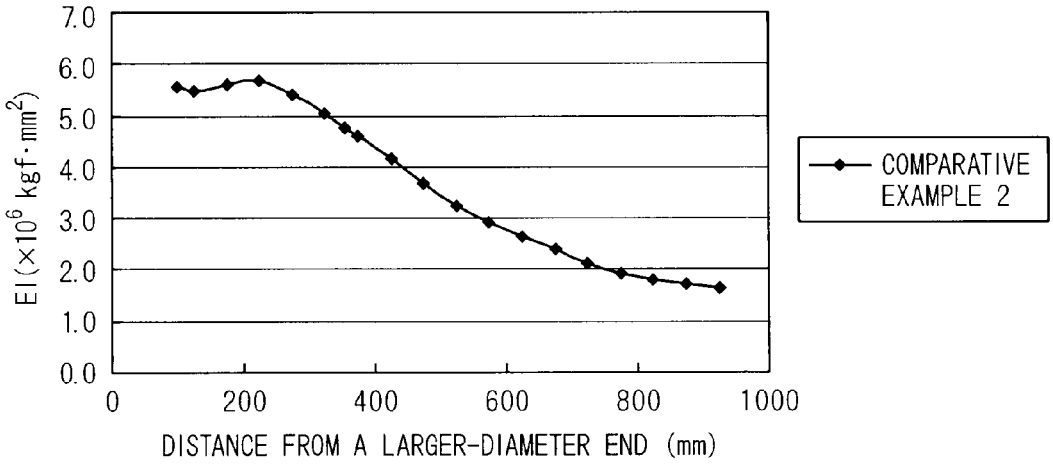
FIG. 9 is an EI distribution illustrating a relation between bending rigidity EI value and a distance from a larger-diameter end of a shaft for a golf club in Comparative Example 2.
Figure 10:
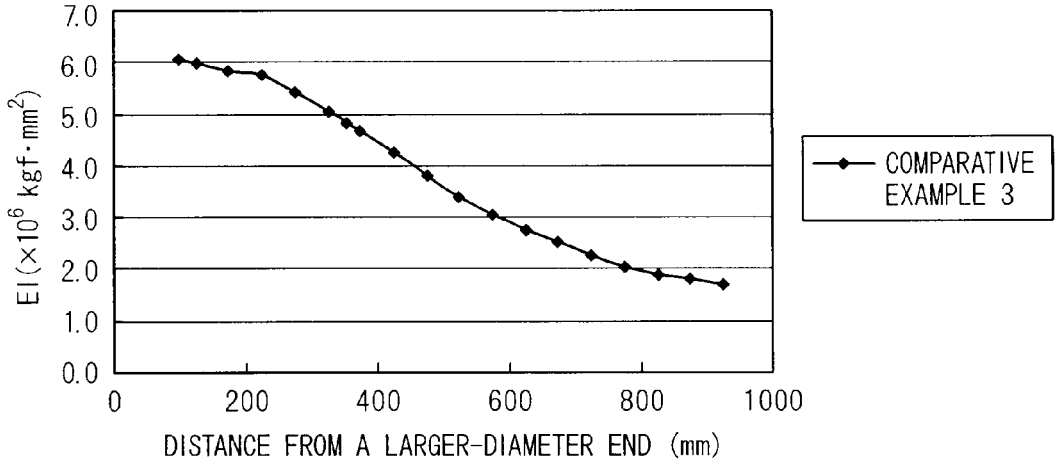
FIG. 10 is an EI distribution illustrating a relation between bending rigidity EI value and a distance from a larger-diameter end of a shaft for a golf club in Comparative Example 3.
Figure 11:
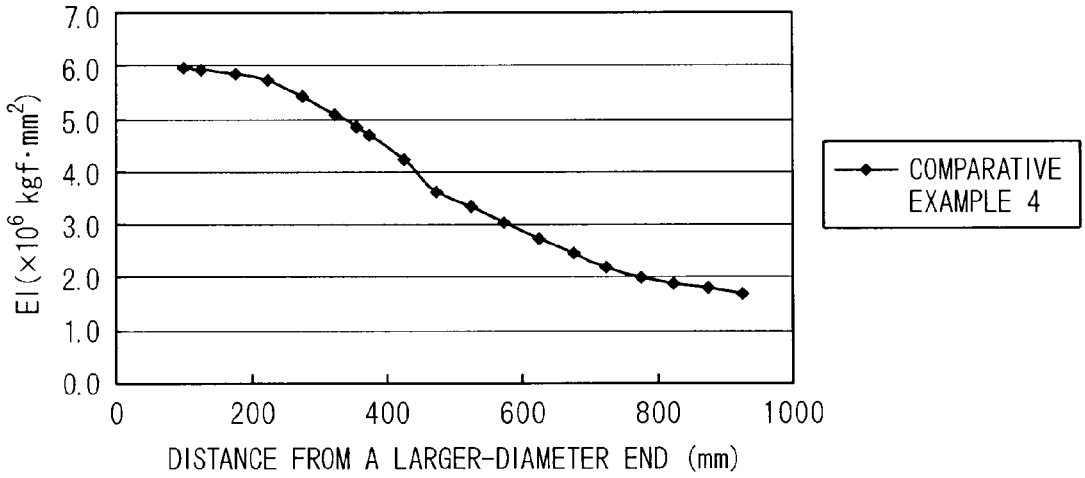
FIG. 11 is an EI distribution illustrating a relation between bending rigidity EI value and a distance from a larger-diameter end of a shaft for a golf club in Comparative Example 4.
Figure 12:
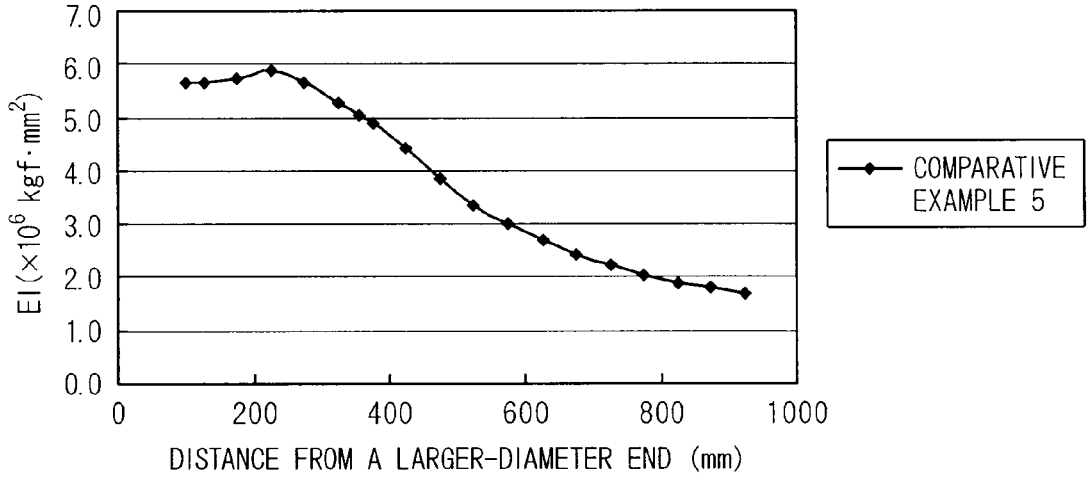
FIG. 12 is an EI distribution illustrating a relation between bending rigidity EI value and a distance from a larger-diameter end of a shaft for a golf club in Comparative Example 5.
Figure 13:
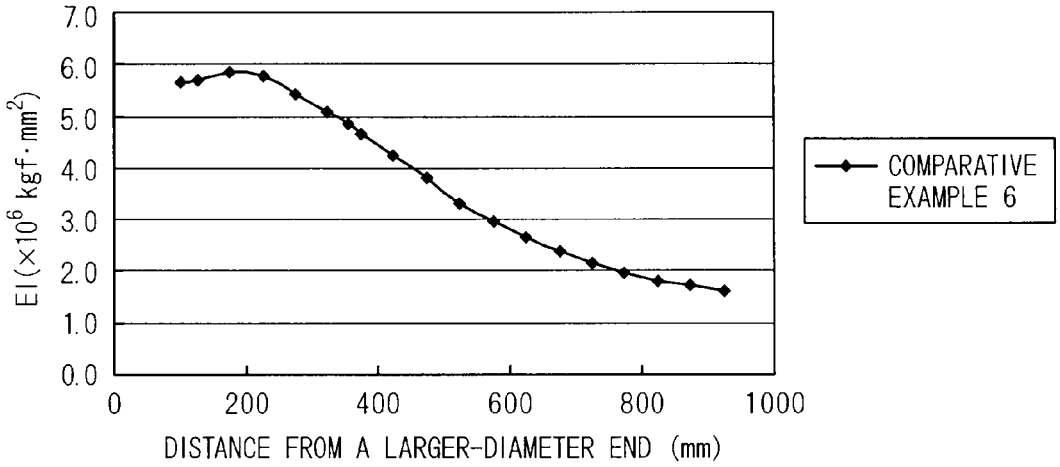
FIG. 13 is an EI distribution illustrating a relation between bending rigidity EI value and a distance from a larger-diameter end of a shaft for a golf club in Comparative Example 6.
Figure 14:
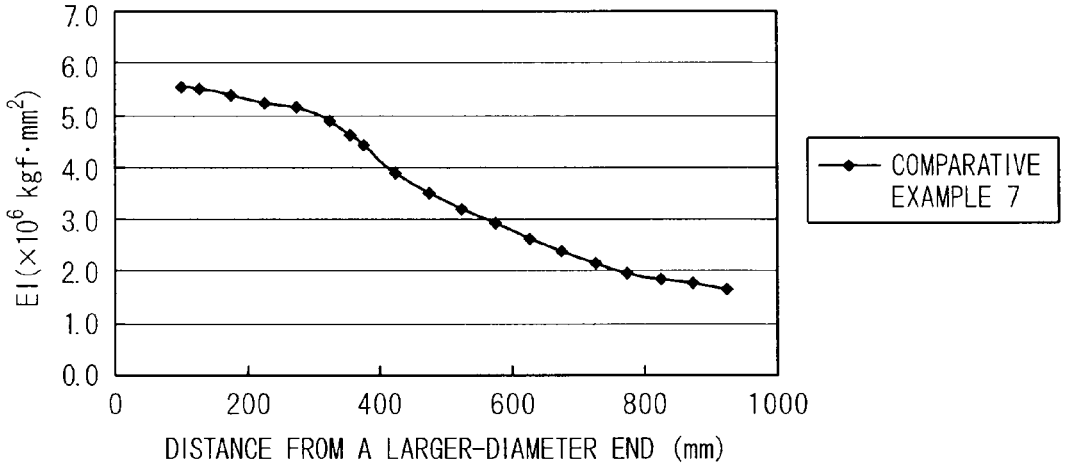
FIG. 14 is an EI distribution illustrating a relation between bending rigidity EI value and a distance from a larger-diameter end of a shaft for a golf club in Comparative Example 7.

Further, the bending rigidity (EI values) measured whenever the measuring point was moved to a position of 100 mm to a position 925 mm from the larger-diameter end of the shaft for the golf club at an interval of 50 mm in a longitudinal direction of the shaft is shown in Table 4 below. Further, FIGS. 6 to 8 show EI distribution illustrating a relation between EI values and a distance from the larger-diameter end of the shaft according to Examples 2 to 4, and FIGS. 9 to 14 show the above EI distribution according to Comparative Examples 2 to 7.

TABLE 4

| Measuring point from larger-diameter end (mm) | Bending rigidity EI($\times10^6$ kgf · mm$^2$) | | | | | | | | | |
|---|---|---|---|---|---|---|---|---|---|---|
| | Ex. 2 | Ex. 3 | Ex. 4 | Comp Ex. 1 | Comp Ex. 2 | Comp Ex. 3 | Comp Ex. 4 | Comp Ex. 5 | Comp Ex. 6 | Comp Ex. 7 |
| 100 | 5.5 | 5.6 | 5.6 | 5.5 | 5.6 | 6.1 | 5.9 | 5.7 | 5.7 | 5.6 |
| 125 | 5.4 | 5.5 | 5.6 | 5.5 | 5.5 | 6.0 | 5.9 | 5.6 | 5.7 | 5.5 |
| 175 | 5.5 | 5.7 | 5.5 | 5.3 | 5.6 | 5.8 | 5.8 | 5.7 | 5.8 | 5.4 |
| 225 | 5.7 | 5.8 | 5.5 | 5.1 | 5.7 | 5.8 | 5.7 | 5.9 | 5.8 | 5.2 |
| 275 | 5.4 | 5.5 | 5.3 | 4.9 | 5.4 | 5.4 | 5.4 | 5.7 | 5.4 | 5.1 |
| 325 | 5.1 | 5.1 | 4.9 | 4.5 | 5.0 | 5.0 | 5.1 | 5.3 | 5.1 | 4.9 |
| 375 | 4.7 | 4.7 | 4.4 | 4.2 | 4.6 | 4.7 | 4.7 | 4.9 | 4.7 | 4.4 |
| 425 | 4.2 | 4.2 | 3.9 | 3.9 | 4.2 | 4.2 | 4.2 | 4.4 | 4.2 | 3.9 |
| 475 | 3.7 | 3.7 | 3.5 | 3.6 | 3.7 | 3.8 | 3.6 | 3.8 | 3.8 | 3.5 |
| 525 | 3.2 | 3.2 | 3.2 | 3.3 | 3.2 | 3.4 | 3.3 | 3.4 | 3.3 | 3.2 |
| 575 | 2.9 | 2.9 | 2.9 | 3.0 | 2.9 | 3.1 | 3.0 | 3.0 | 2.9 | 2.9 |
| 625 | 2.6 | 2.6 | 2.6 | 2.7 | 2.6 | 2.8 | 2.7 | 2.7 | 2.6 | 2.6 |
| 675 | 2.4 | 2.4 | 2.4 | 2.4 | 2.4 | 2.5 | 2.4 | 2.4 | 2.4 | 2.4 |
| 725 | 2.1 | 2.1 | 2.1 | 2.2 | 2.1 | 2.3 | 2.2 | 2.2 | 2.1 | 2.2 |
| 775 | 1.9 | 1.9 | 1.9 | 2.0 | 1.9 | 2.0 | 2.0 | 2.0 | 1.9 | 2.0 |
| 825 | 1.8 | 1.8 | 1.8 | 1.9 | 1.8 | 1.9 | 1.9 | 1.9 | 1.8 | 1.8 |
| 875 | 1.7 | 1.7 | 1.8 | 1.8 | 1.7 | 1.8 | 1.8 | 1.8 | 1.7 | 1.8 |
| 925 | 1.6 | 1.6 | 1.6 | 1.7 | 1.6 | 1.7 | 1.7 | 1.7 | 1.6 | 1.6 |

Club balance: D0
Club vibration frequency: 227 cpm
Head volume: 460 cc
Head weight: 195 g
Loft angle: 9°

The club balance is a value calculated by obtaining a length (inch) from a gravity point of the golf club to a fulcrum point by using a prorythmic scale in which the larger-diameter end of the grip and a position of 14 inches from the larger-diameter end are assumed to be fulcrum points, and then multiplying the length (inch) from the gravity point to the fulcrum point by the club weight (ounce). It is defined that D0 is a reference value when a value is 213.5, and if a value is increased or decreased by 1.75, one point is increased or decreased.

<Evaluation of Hitting Ball>

Feeling evaluation on the golf club according to Examples 2 to 4 and Comparative Examples 2 to 7 was performed by the same method as Example 1. The evaluation results are shown in Table 5.

TABLE 5

| Example/ Comparative Example | Kind of metal wire prepreg | Result of feeling evaluation (Comparative Example 1 was set to '3' for a comparative evaluation a | b | c | d | e | average |
|---|---|---|---|---|---|---|---|
| Comparative Example 1 | — | 3 | 3 | 3 | 3 | 3 | 3.0 |
| Comparative Example 2 | C | 1 | 4 | 3 | 4 | 4 | 3.2 |
| Comparative Example 3 | D | 2 | 1 | 2 | 2 | 4 | 2.2 |
| Comparative Example 4 | E | 4 | 2 | 3.5 | 5 | 3 | 3.5 |
| Comparative Example 5 | F | 3 | 2 | 4 | 3 | 3 | 3.0 |
| Example 1 | A-1 | 4 | 4 | 4 | 2 | 4 | 3.6 |
| Example 2 | A-1 | 5 | 4 | 5 | 3 | 3 | 4.0 |
| Example 3 | B | 4 | 5 | 3.5 | 4.5 | 3 | 4.0 |
| Example 4 | A-2 | 2 | 4 | 5 | 2 | 4 | 3.3 |
| Comparative Example 6 | A-3 | 1 | 1 | 2 | 4 | 4 | 2.4 |
| Comparative Example 7 | A-4 | 2 | 2 | 3 | 5 | 2 | 2.8 |

As compared with Comparative Examples 1 to 7, the evaluations of Examples 2 to 4 were high, and thus the results were obtained in which the golf club using the shaft for the golf club according to the present invention has a good feeling when used.

Further, the flying distance and the right and left deviation in the golf clubs according to Examples 2 to 4 and Comparative Examples 1 to 7 were measured by the same method as Example 1. The results of flying distance and the right and left deviation are shown in Table 6.

TABLE 6

| | Average of flying distance (yrd) | Right and left deviation (SD) (yrd) |
|---|---|---|
| Comparative Example 1 | 220.8 | 17.4 |
| Comparative Example 2 | 220.7 | 15.3 |
| Comparative Example 3 | 221.9 | 16.6 |
| Comparative Example 4 | 221.1 | 17.7 |
| Comparative Example 5 | 222.0 | 16.2 |
| Example 2 | 232.7 | 13.3 |
| Example 3 | 229.0 | 11.1 |
| Example 4 | 226.4 | 8.5 |
| Comparative Example 6 | 220.2 | 23.4 |
| Comparative Example 7 | 224.9 | 15.9 |

The average flying distance of the hit ball was about 220 yrd in Comparative Examples 1 to 7, but the average flying distance was increased to about 230 yrd in Examples 2 to 4. Further, the right and left deviation was 17.5 yrd in standard variation in Comparative Examples 1 to 7, but the right and left deviation was a low value of 11.0 yrd in Examples 2 to 4. In addition, in order to statistically show an apparent boundary line between Comparative Examples and Examples, as a result of using the Wilcoxon sign-rank test, there was a significant difference of $P<0.01$ in the flying distance and $P<0.05$ at a landing point of right and left directions.

From the above results, in the case in which the shaft for the golf club according to the present invention is used in the long-sized golf club having a club length of 45.2 inches, the use feeling was good, the flying distance of the hit ball was improved, and the variation in the directivity of the hit ball was reduced.

The invention claimed is:

1. A shaft for a golf club comprising:

a plurality of fiber-reinforced resin layers; and a plurality of circumferentially oriented metal wires which are provided at intervals of 1 mm to 4 mm at such a portion of the shaft having a length in an axial direction of more than 100 mm and less than 300 mm and being centered at a position of $3.25\times10^2$ mm from a larger-diameter end of the shaft.

2. The shaft according to claim 1, wherein the plurality of circumferentially oriented metal wires are provided at intervals of 1 mm to 4 mm at such a portion of the shaft having a length in an axial direction of more than or equal to 160 mm and less than or equal to 240 mm and being centered at a position of $3.25\times10^2$ mm from the larger-diameter end of the shaft.

3. The shaft according to claim 1, wherein the plurality of circumferentially oriented metal wires are provided at intervals of 1 mm to 4 mm at such a portion of the shaft having a length in an axial direction of 240 mm and being centered at a position of $3.25\times10^2$ mm from the larger-diameter end of the shaft.

4. The shaft according to claim 1, wherein the metal wire has a flat cross section, a maximum thickness of 17 μm to 25 μm and a width of 180 μm to 280 μm.

5. The shaft according to claim 1, wherein the metal wire is an amorphous metal wire having tensile strength of 200 to 400 kgf/mm$^2$, a degree of elongation of 1 to 3.5%, and Young's modulus of 14000 to 17000 kgf/mm$^2$.

* * * * *